US007374459B2

(12) United States Patent
Lin

(10) Patent No.: US 7,374,459 B2
(45) Date of Patent: May 20, 2008

(54) NETWORK CONNECTOR

(75) Inventor: Yen-Lin Lin, Luchou (TW)

(73) Assignee: Jyh Eng Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 11/753,598

(22) Filed: May 25, 2007

(65) Prior Publication Data

US 2007/0281502 A1 Dec. 6, 2007

(30) Foreign Application Priority Data

Jun. 2, 2006 (TW) ..... 95209582 U

(51) Int. Cl.
*H01R 24/00* (2006.01)

(52) U.S. Cl. ..... 439/676; 439/941

(58) Field of Classification Search ..... 439/620.06, 439/676, 941

See application file for complete search history.

(56) References Cited

U.S. PATENT DOCUMENTS 4,274,691 A * 6/1981 Abernethy et al. ..... 439/507
5,085,596 A * 2/1992 Bowen et al. ..... 439/497
6,520,806 B2 * 2/2003 Phommachanh ..... 439/676
6,896,557 B2 * 5/2005 Aekins et al. ..... 439/676
2004/0203292 A1 * 10/2004 Eberle et al. ..... 439/676
2007/0021008 A1 * 1/2007 Wang ..... 439/630
2007/0212946 A1 * 9/2007 Bert et al. ..... 439/676
2007/0281502 A1 * 12/2007 Lin ..... 439/66

* cited by examiner

*Primary Examiner*—James Harvey
(74) *Attorney, Agent, or Firm*—Ming Chow; Sinorica, LLC

(57) ABSTRACT

A network connector, it is provided with an insulation base provided in a front face thereof with a socket for insertion of a plug on a network electric line, and a gold-plating contact module is inserted in the insulation base. The gold-plating contact module has eight gold-plating contacts which are extended out of a printed circuit board. The tailing ends of the gold-plating contacts remote from the circuit board are laid out according to a sequence from a first one to an eighth one of the gold-plating contacts in the socket to form a contact area for electrically connecting a plug on a network electric line. The fourth gold-plating contact and the fifth gold-plating contact are crossed with each other at an area between the contact area and the circuit board, this forms offsetting action on positive and negative electric charges of noisy signals between the crossing area and the circuit board to enhance transmitting performance of said network connector.

2 Claims, 7 Drawing Sheets

NETWORK CONNECTOR

BACKGROUND OF THE INVENTION

1. Field of the Invention

The present invention relates to an innovative structure of a network connector, and especially to a network connector that can offset the noisy signals in electric voltage balancing with gold-plating contacts.

2. Description of the Prior Art

Most often seen network connectors are those of RJ 45, they are used to connect a plug on a network electric line to transmit data. A normal network connector has therein eight gold-plating contacts 92 extending from a printed circuit board 91, as is shown in FIG. 1, to electrically connect a network plug. And as shown in FIG. 2 which is a schematic view showing laying out of the gold-plating contacts 92, wherein an area A1 is an area for electric connecting of the gold-plating contacts 92 with the plug, A2 represents an noisy signal induction length, while A3 represents an area for connecting and compensation; in the eight gold-plating contacts 92 arranged in proper order, the interference happens most often in the third-sixth gold-plating contact 92, this is because that the fourth gold-plating contact 92 is a signal source of negative electric charge, while the fifth gold-plating contact 92 is a signal source of positive electric charge, thereby the third gold-plating contact 92 is induced to have negative electric charge noisy signals, and the sixth gold-plating contact 92 is induced to have positive electric charge noisy signals, these render inferior of the characteristic of transmission.

To solve such a problem of interference, generally it is not the improvement on the designing of gold-plating contacts that is been made. It's the designing of PCB layout on a circuit board that is been used to eliminate the influence of the interference; as a result of this, an overly large interference noisy signal voltage occurs on the gold-plating contacts, and only the circuit board is been used to make voltage balancing to offset the noisy signals. However, the ability to offsetting such a problem is always insufficient, and further improvement is required.

SUMMARY OF THE INVENTION

The inventor of the present invention studied the defects resided in the conventional technique in many aspects in order to improve the design of gold-plating contacts used in a network connector; the inventor applied the principle of voltage balancing for offsetting to the design of gold-plating contacts with a goal to immediately offset positive and negative electric charges which make noisy signals by interference at the gold-plating contacts, that is, the action of noisy signal offsetting is done earlier on the gold-plating contacts, while the circuit board is only used to make a little compensation; this can largely lower the noisy signals and enhance the transmitting performance of a network connector.

The network connector provided by the present invention is provided with an insulation base provided in a front face thereof with a socket for insertion of a plug on a network electric line, and a gold-plating contact module is inserted in the insulation base. The gold-plating contact module has eight gold-plating contacts which are extended out of a printed circuit board. The tailing ends of the gold-plating contacts remote from the circuit board are laid out according to a sequence from the first one to the eighth one of the gold-plating contacts in the socket to form a contact area for electrically connecting a plug on a network electric line. The fourth gold-plating contact and the fifth gold-plating contacts are crossed with each other at an area between the contact area and a circuit board, this forms offsetting action on positive and negative electric charges of noisy signals between the crossing area and the circuit board to enhance transmission performance of said network connector.

According to the network connector provided by the present invention, after testing, it is known that the present invention can lower averagely up to 10 dB noisy signal as compared with the conventional network connector with mutually parallel gold-plating contacts.

The present invention will be apparent in its structure, features and effect of use after reading the detailed description of the preferred embodiment thereof in reference to the accompanying drawings.

DETAILED DESCRIPTION OF THE PREFERRED EMBODIMENT

Figure 1:
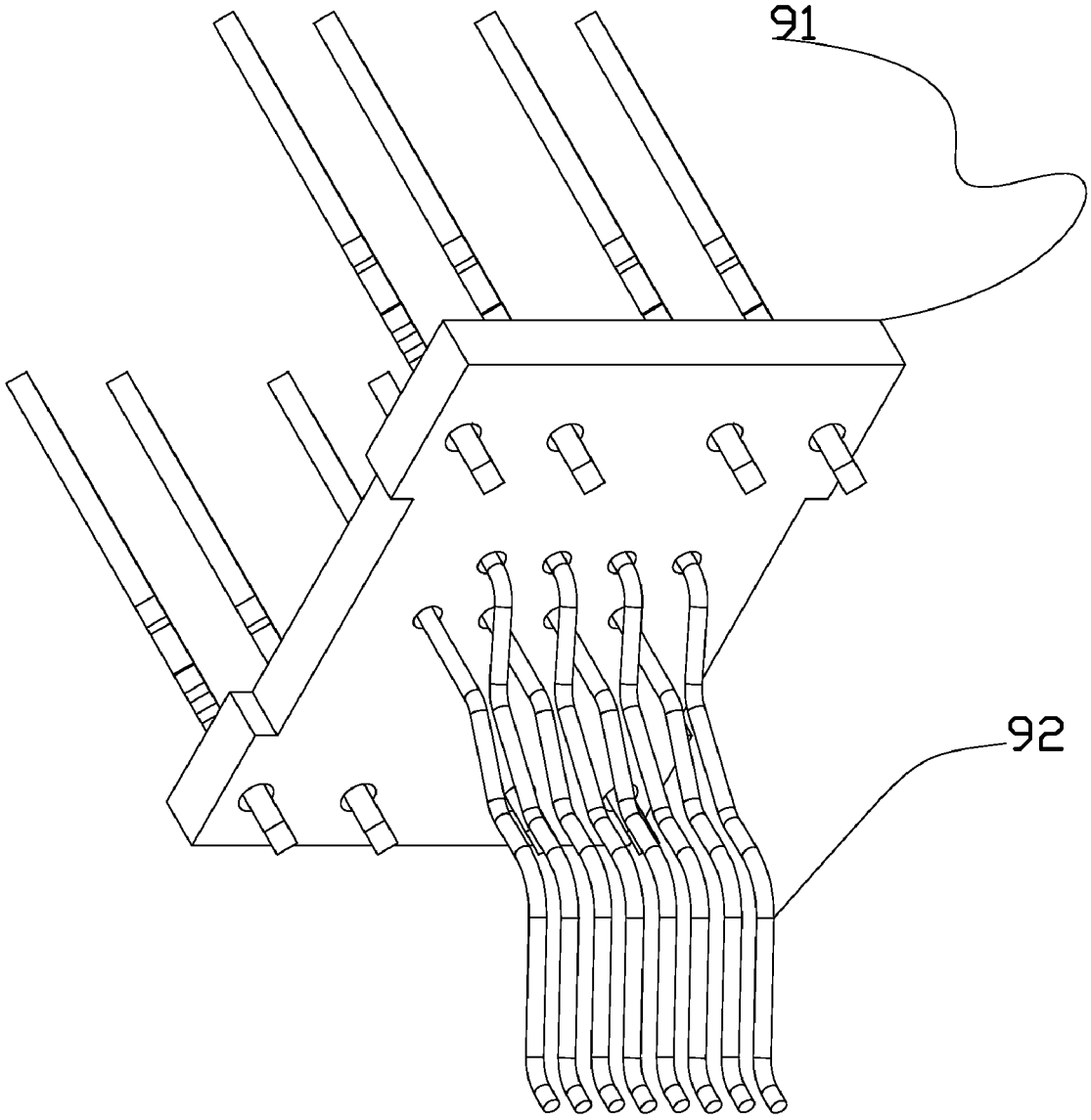
FIG.1 PRIOR ART
FIG. 1 is a perspective view showing the gold plating contacts of a conventional network connector and allocation of its circuit board.
Figure 2:
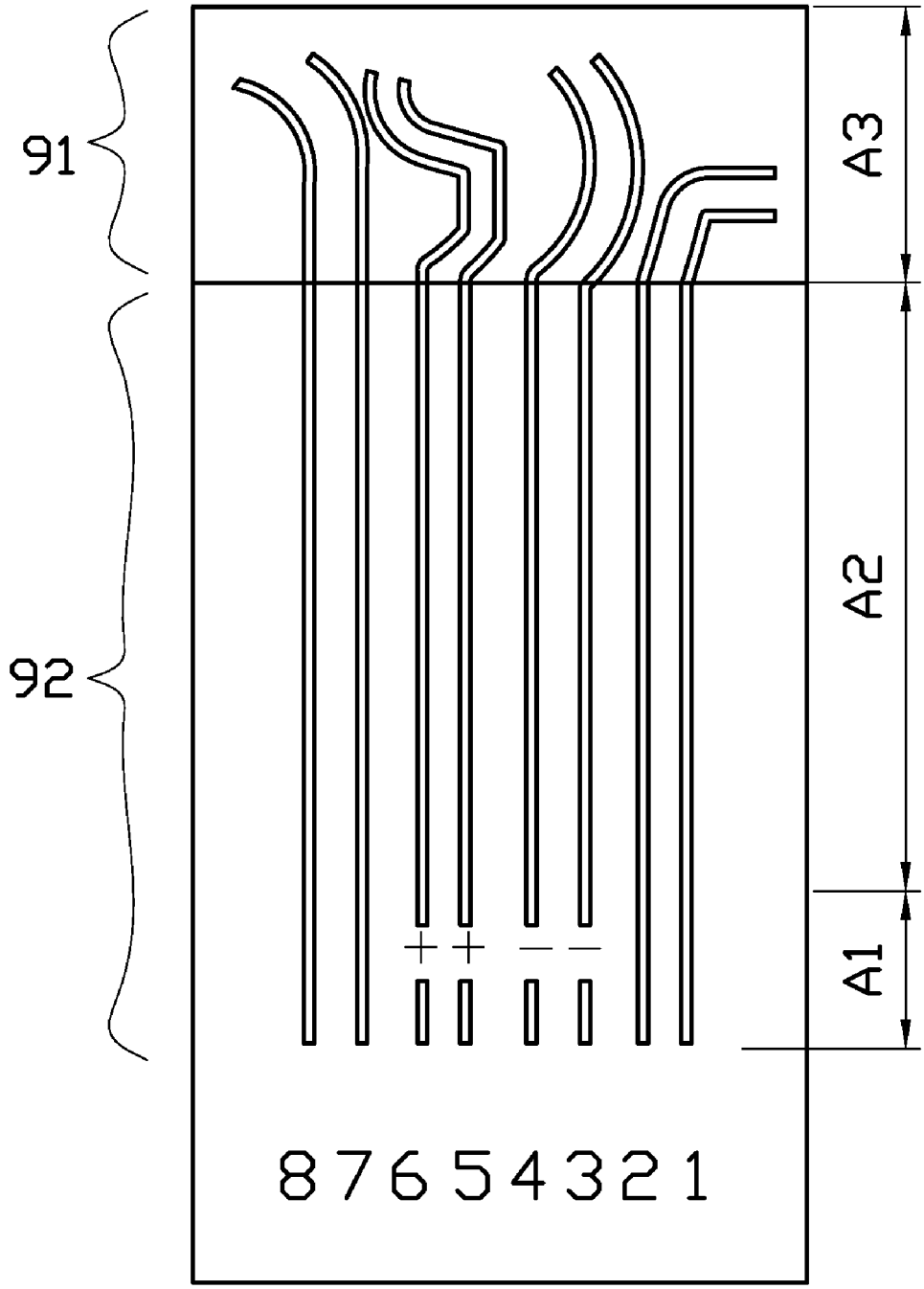
FIG.2 PRIOR ART
FIG. 2 is a schematic view showing the design of the gold-plating contacts of the conventional network connector.
Figure 3:
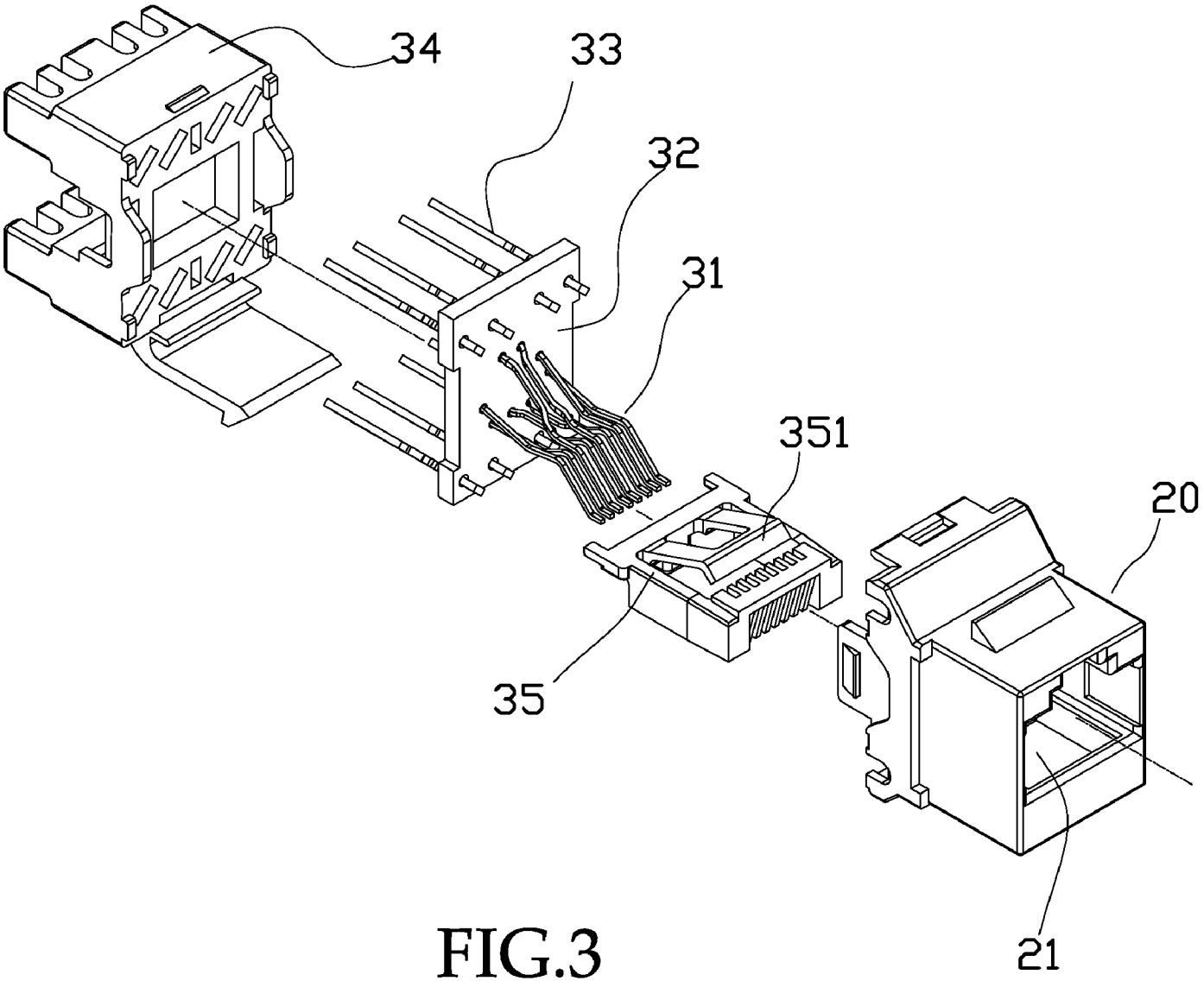
FIG. 3 is an anatomic perspective view showing a network connector of the present invention.
Figure 4:
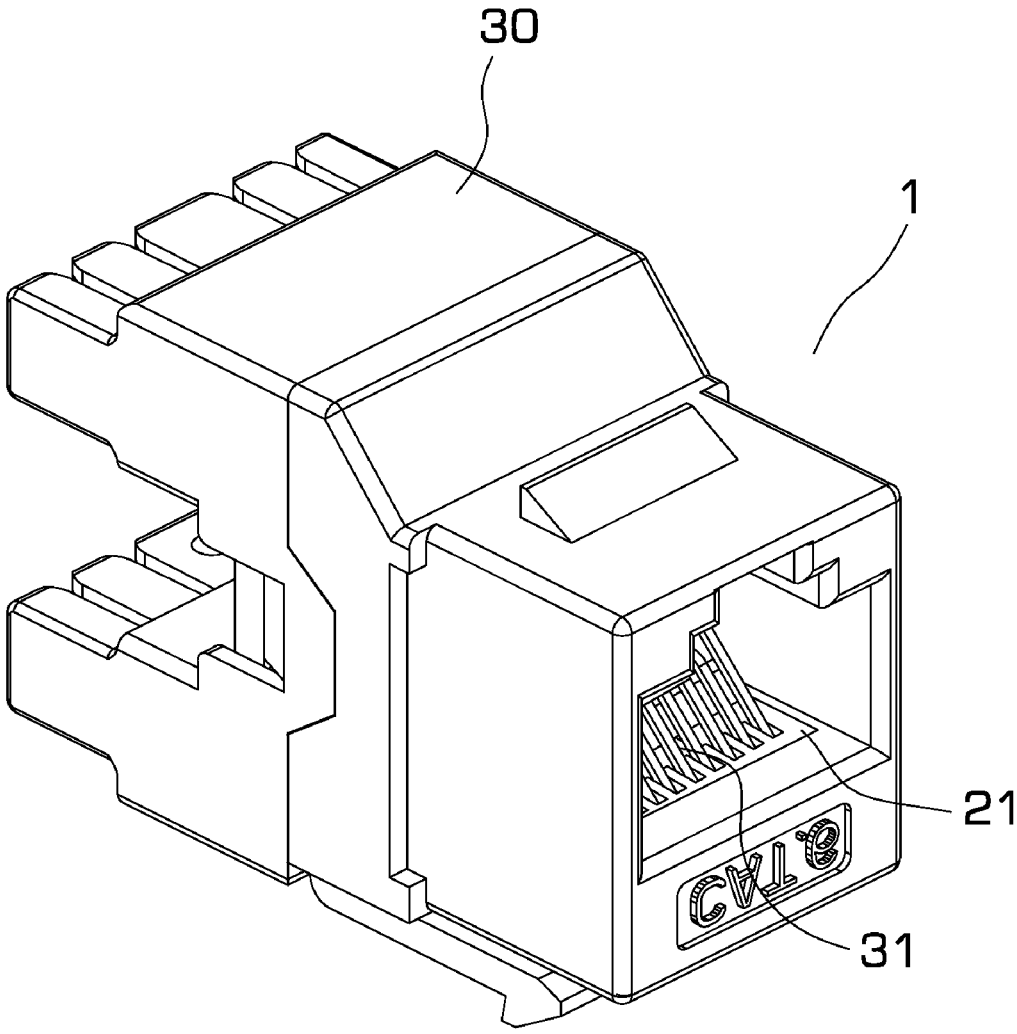
FIG. 4 is a perspective view showing the network connector of the present invention after assembling

Referring to FIGS. 3 and 4, the network connector of the present invention at least has an insulation base 20 and a gold-plating contact module 30.

The insulation seat 20 is provided in its front face with a socket 21 for insertion of a plug on a network electric line, and the gold-plating contact module 30 is inserted in the insulation base 20.

Figure 5:
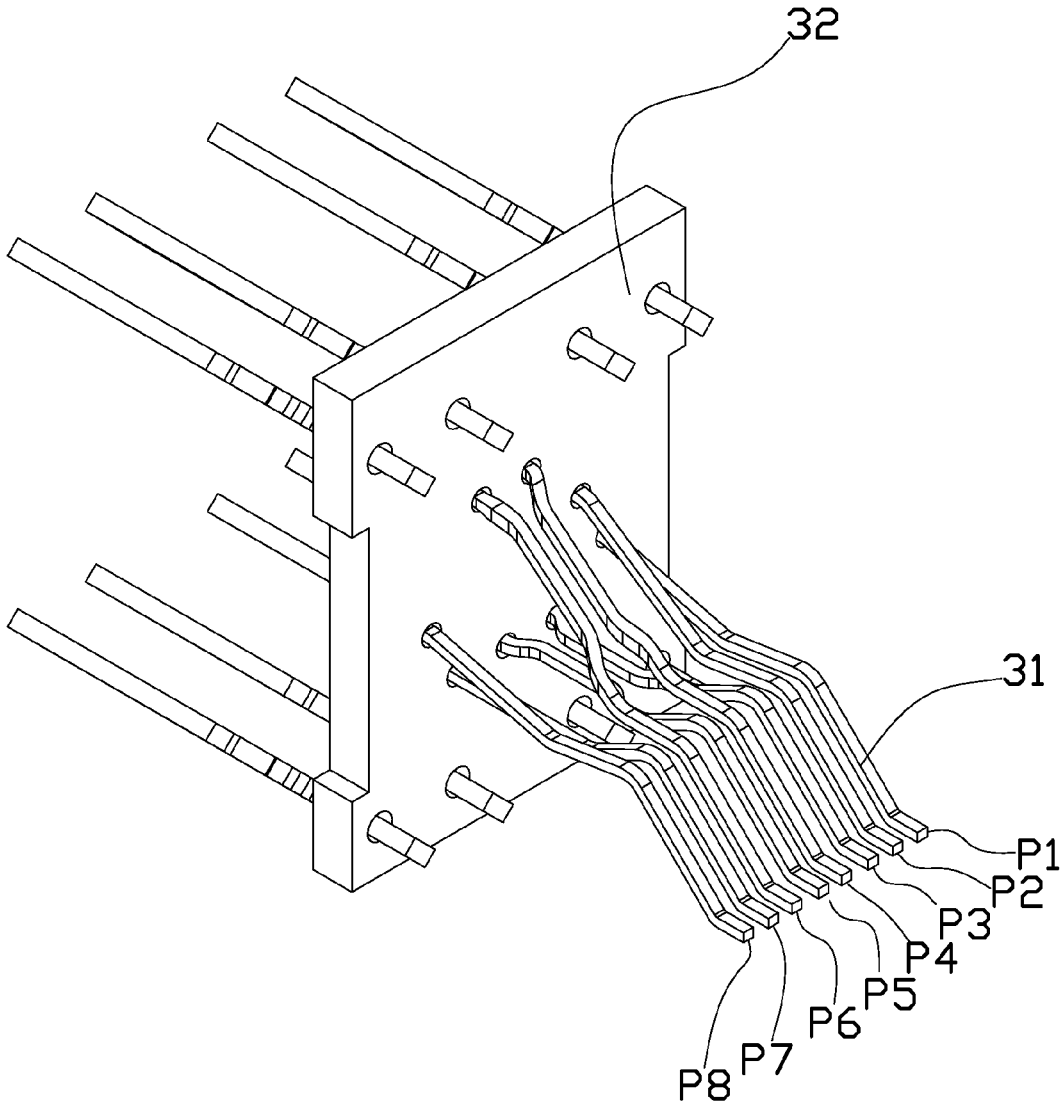
FIG. 5 is a perspective view showing the gold-plating contacts of the network connector and allocation of its circuit board of the present invention.

The gold-plating contact module 30 has eight gold-plating contacts 31 which are numbered as P1~P8, each gold-plating contact 31 is extended out of a printed circuit board 32, as are shown in FIGS. 3 and 5. The printed circuit board 32 is provided on the rear thereof with a plurality of piercing terminals 33; the piercing terminals 33 are extended into a plastic main housing 34; and the gold-plating contact module 30 is provided with a spring latch supporting unit 35, the unit 35 has an upwardly tilting supporting spring latch 351 for supporting the tailing ends of the gold-plating contacts 31. The tailing ends of the gold-plating contacts 31 remote from the printed circuit board 32 are laid out sequentially in the socket 21 of the insulation base 20 to form a contact area for electrically connecting the plug on the network electric line.

Figure 6:
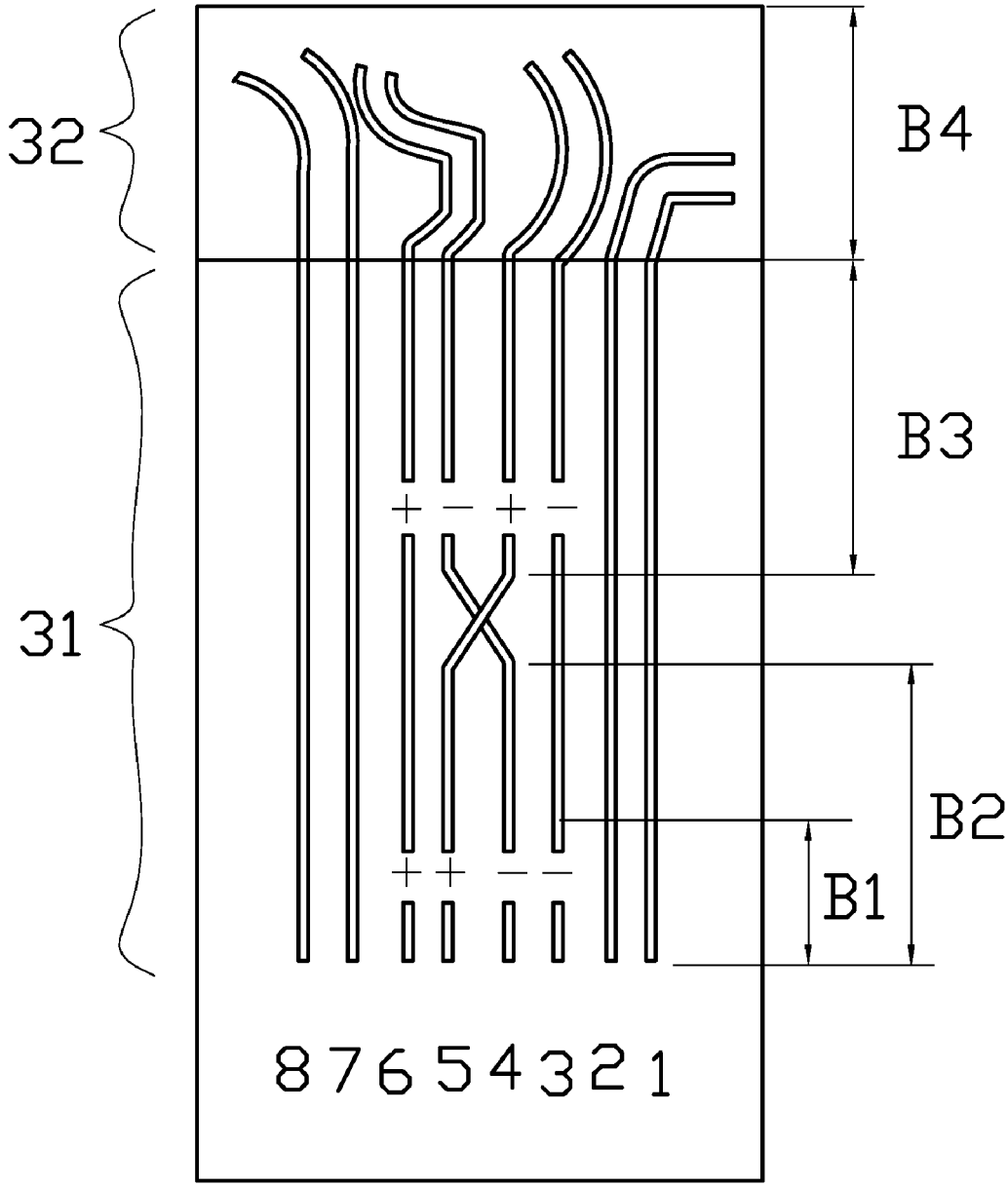
FIG. 6 is a schematic view showing the design of the gold-plating contacts of the network connector of the present invention.
Figure 7:
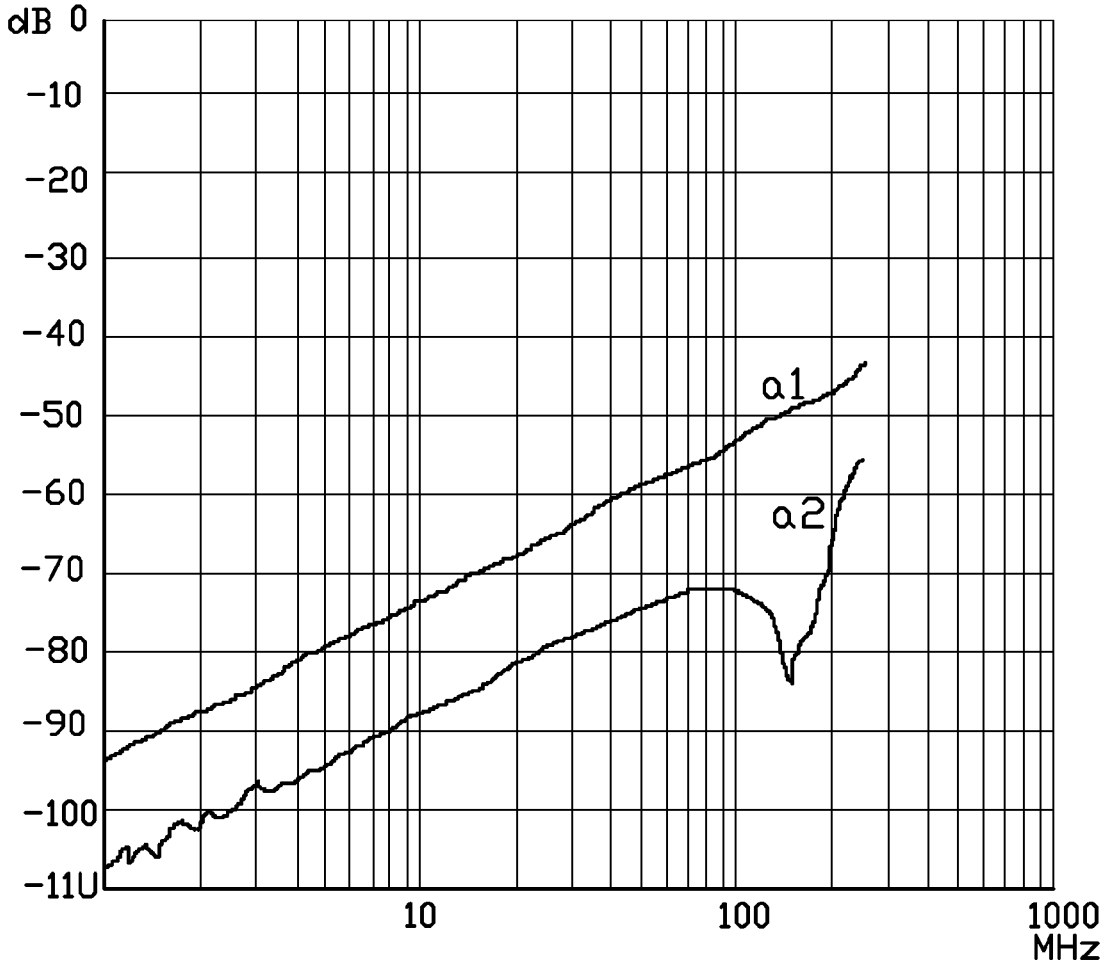
FIG. 7 is a diagram showing the testing results of the network connectors of the conventional network connector and the network connector of the present invention.

The most principal goal of the present invention is to apply the principle of voltage balancing for offsetting to the design of gold-plating contacts 31, as is shown in FIG. 6, the eight gold-plating contacts 31 are extended out of the printed circuit board 32, an area B1 is for contacting with the plug, B2 represents an noisy signal induction length, the fourth gold-plating contact P4 and the fifth gold-plating contact P5 are crossed with each other at an area between said contact area B1 and the printed board 32, this forms an offsetting area B3 before the printed board 32 for offsetting the positive and negative electric charges of the noisy signals, that is, the action of noisy signal offsetting is done earlier before the printed circuit board 32, while the printed circuit board 32 is only used to make a little compensation (the connecting of the electronic line in circuit board and compensating at an area B4); this can largely lower the noisy signals and enhance the transmitting performance of the network connector.

The above stated is the improvement on gold-plating contacts of a network connector of the present invention that has better transmitting performance than that of the conventional technique. Having thus described the technical structure of my invention with practicability and improvement, what I claim as new and desire to be secured by Letters Patent of the United States is:

1. A network connector, said network connector is provided with an insulation base provided in a front face thereof with a socket for insertion of a plug on a network electric line, and a gold-plating contact module is inserted in said insulation base; said gold-plating contact module has eight gold-plating contacts which are extended out of a printed circuit board of said gold-plating contacts; tailing ends of said gold-plating contacts remote from said printed circuit board are laid out according to a sequence from a first, a second, a third, a fourth, a fifth, a sixth, a seventh to an eighth one of said gold-plating contacts in said socket to form a contact area for electrically connecting a plug on a network electric line; said network connector is characterized in that:

said fourth gold-plating contact and said fifth gold-plating contacts are crossed with each other at an area between said contact area and said printed circuit board, this forms offsetting action on noisy signals made by positive and negative electric charges between said crossing area and said printed circuit board to enhance transmission performance of said network connector;

wherein said printed circuit board of said gold-plating contact module is provided on its rear with a plurality of piercing terminals; said piercing terminals are extended into a plastic main housing for said gold-plating contacts; and said gold-plating contact module is provided with a spring latch supporting unit, said spring latch supporting unit has an upwardly tilting supporting spring latch for supporting said tailing ends of said gold-plating contacts.

2. The network connector as claimed in claim 1, wherein said printed circuit board provides functions of balancing and compensation.

* * * * *